US005933681A

United States Patent [19]

Suzuki

[11] Patent Number: 5,933,681

[45] Date of Patent: Aug. 3, 1999

[54] IMAGE FORMING APPARATUS

[75] Inventor: Hiroyuki Suzuki, Yokohama, Japan

[73] Assignee: Canon Kabushiki Kaisha, Tokyo, Japan

[21] Appl. No.: 09/144,493

[22] Filed: Aug. 31, 1998

[30] Foreign Application Priority Data

Aug. 29, 1997 [JP] Japan ..... 9-249745

[51] Int. Cl.[6] ..... G03G 15/02

[52] U.S. Cl. ..... 399/50; 399/150; 399/174; 399/175

[58] Field of Search ..... 399/50, 168, 174, 399/175, 176, 149, 150; 361/221, 225

[56] References Cited

U.S. PATENT DOCUMENTS

| | | | |
|---|---|---|---|
| 5,305,177 | 4/1994 | Aoki et al. | 361/225 |
| 5,835,821 | 11/1998 | Suzuki et al. | 399/50 X |
| 5,839,026 | 11/1998 | Ko | 399/174 X |
| 5,842,081 | 11/1998 | Kaname et al. | 399/50 |

FOREIGN PATENT DOCUMENTS

| | | |
|---|---|---|
| 3-52058 | 8/1991 | Japan . |
| 6-3921 | 1/1994 | Japan . |

*Primary Examiner*—S. Lee
*Attorney, Agent, or Firm*—Fitzpatrick, Cella, Harper & Scinto

[57] ABSTRACT

An image forming apparatus includes an image bearing member; a charging member, contactable to the image bearing member, for being supplied with a voltage to electrically charge the image bearing member, the charging member having a resistance which is larger when it is supplied with a voltage of 50V than when it is supplied with a voltage of 500V; developing device for developing with toner an electrostatic image formed on the image bearing member using charging operation of the charging member, the developing means being capable of removing the toner from the image bearing member; wherein the voltage is an oscillating voltage, and a ratio $T_{up}$ of time period when a voltage level thereof is in a side of a charging polarity of the charging member beyond an average voltage in one period of the oscillating voltage to a length of time of one period of the oscillating voltage, and a ratio $T_{down}$ of time period when the voltage level thereof is in a side of a polarity opposite from the charge polarity beyond the average voltage to the length of time of one period of the oscillating voltage, satisfy:

$$T_{up}>T_{down}.$$

9 Claims, 11 Drawing Sheets

IMAGE FORMING APPARATUS

FIELD OF THE INVENTION AND RELATED ART

The present invention relates to an image forming apparatus comprising a charging member contactable to an image bearing member to charge the image bearing member such as a photosensitive member or a dielectric member.

1) transfer type image forming apparatus

An image forming apparatus(copying machine, printer, facsimile machine or the like) is known which comprises an image bearing member such an electrophotographic photosensitive member or a dielectric member for electrostatic recording, a charging means for electrically charging the image bearing member, image information writing means for forming an electrostatic latent image on the charged surface of the image bearing member, developing means for developing into a toner image the thus formed the electrostatic latent image, and transferring means for transferring the toner image onto the recording material, wherein the image bearing member is repeatedly used for the image formation (transfer type).

FIG. 13 is a general arrangement of an example of a conventional transfer type electrophotographic apparatus.

Designated by 101 is an electrophotographic photosensitive member of a rotatable drum type as an image bearing member(photosensitive drum), which is rotatable in the clockwise direction indicated by the arrow at a predetermined peripheral speed (process speed).

The photosensitive drum 101, during the rotation, is uniformly charged to a predetermined polarity and potential by a charger 102 (charging means). The charging means 102 is a charging roller which is a contact charging member, in this example. Designated by S1 is a charging voltage application source for the charging roller 102.

Then, the photosensitive member is exposed to image exposure L by an unshown image exposure means (projection exposure means for an original image, laser scanning exposure means or the like). By this, the uniformly charged surface of the photosensitive drum 101 is selectively discharged (or the charge is attenuated) in accordance with the pattern of the exposure, so that electrostatic latent image is formed on the surface of the photosensitive drum 101.

The electrostatic latent image is developed by the developing means 103 into a toner image. Designated by 103*a* is a developing member (developing roller, developing sleeve or another developer carrying member), S2 is a developing voltage application source for the developing member 103*a*.

On the other hand, a transfer material P as a recording material is fed from an unshown sheet feeding mechanism portion and is supplied to a transfer portion between transferring means 104 and the photosensitive drum 101 at a predetermined control timing, so that toner image is sequentially transferred onto the surface of the sheet feeding transfer material P from the surface of the photosensitive drum 101. The transferring means 104 is a transfer roller in this example. Designated by S3 is a transfer voltage application voltage source for the transfer roller 104.

Then, the transfer material P is separated from the surface of the rotatable photosensitive drum 101, and is introduced to unshown fixing means where it is subjected to the fixing process, and then it is outputted as a print (copy or print).

The surface of the photosensitive drum 101 after toner image transfer onto the transfer material P, is cleaned by a cleaning means (cleaner) 105 so that residual toner is removed, and it is used for the image formation again. Designated by 105*a* is a cleaning element such as a cleaning blade.

2) contact charging device

As for the photosensitive drum 101 as the image bearing member and the image forming process means for the charging, the exposure, the development, the transfer, the cleaning, the fixing, and the devices 102–105 usable in such an image forming apparatus, there are various types.

For example, as for the charging means 102 for uniformly charging the surface of the photosensitive drum 101 to a predetermined polarity and the potential, a corona charger has conventionally been used. The corona charger is faced to the photosensitive drum without contact thereto, and the photosensitive drum surface is exposed to corona shower generated by the corona charger supplied with a high voltage.

Recently, a contact charging device is put into practice from the standpoint of the advantage of low ozone production, low electric power or the like over the corona charger.

In a contact charging device, an electroconductive member (contact charging member) having an adjusted resistance is contacted to a member to be charged, and the contact charging member is supplied with a predetermined charged potential, by which the surface of the member to be charged is charged to a predetermined polarity and potential.

The contact charging member may be a roller type using electroconductive rubber (charging roller or electroconductive rubber roller), a blade type using an electroconductive rubber (charging blade), a magnetic brush type using electroconductive magnetic particles (magnetic brush charger), a furbrush type using electroconductive fibers (furbrush charger) or the like.

In the magnetic brush charger, the electroconductive magnetic particles are confined magnetically as a magnetic brush directly on a magnet or on a sleeve containing therein a magnet. The magnetic brush portion of the magnetic particles are rotated or stationary and are contacted to the surface of the member to be charged, and it is supplied with a voltage to effect the contact charging for the surface of the member to be charged. This is preferable from the standpoint of the stability of charging contact.

It is classified into a DC applying type wherein the charging bias application to the contact charging member contains only a DC voltage, and an AC applying type wherein it is an oscillating voltage containing a DC component and an alternating (AC) component.

In one type of contact charging, the charging by discharge phenomenon is dominant as disclosed in Japanese Patent Application Publication No. HEI-3-52058 for example, and in another type, the charging by the direct injection of the charge to the surface of the member to be charged is dominant as disclosed in Japanese Laid-open Patent Application No. HEI-6-3921 for example.

In the injection charging type, the use is made with such a contact charging member and with an injection-chargeable member to be charged such as an image bearing member having a normal organic photosensitive member and a surface layer containing electroconductive fine particles dispersed therein or an amorphous silicon photosensitive member, and then the charged potential of the surface of the member to be charged is equivalent to the voltage of the DC component of the voltage application to the contact charging member.

Since the injection charging type substantially does not use the discharge phenomenon, the required charging potential to be applied is substantially equal to the intended surface potential of the member to be charged, and the ozone is not produced (complete ozoneless), and the low electric power type charging is accomplished.

3) cleaner-less system

As for a transfer type image forming apparatus, a cleaner-less system (cleanerless process) has been proposed in consideration of environmental health, downsizing of devices, cost reduction and the like.

In an image forming apparatus using the cleaner-less system, a cleaning device 105 exclusively for removing residual toner from the residual of the surface of the image bearing member 101 after the toner image transfer onto the transfer material P, may be omitted, and the residual toner is removed in the next developing operation by the developing member 103*a,* more particularly, by a potential difference Vback (fog removing potential) which is a potential difference between the DC voltage (developing voltage) applied to the developing member 103*a* of the developing means and the surface potential of the image bearing member 101 (simultaneous development and cleaning or simultaneous development and collection). This is advantageous as follows.

(1) since the cleaning device 105 is omitted, the downsizing and the cost reduction of the image forming apparatus is accomplished.

(2) the residual toner collected by the developing means 103 may used again for development, so that no residual toner results (environmental health).

(3) since the cleaning device 105 is not provided, there is no damage of the surface of the image bearing member due to the rubbing between the cleaning device 105 and the image bearing member 101, or the damage of the charge injection layer in the case of the injection-chargeable image bearing member.

In a transfer type image forming apparatus of the cleanerless type, when the use is made with a contact charging device as a charging means 102 for the image bearing member 101, the untransferred toner is deposited to and mixed to the contact charging member contacted to the image bearing member surface at a position between the developing zone and the transfer portion downstream of the transfer portion with respect to the movement direction of the image bearing member surface, so that contact charging member is contaminated with the toner.

Normally, the toner particles have a relatively high electric resistance, and therefore, the toner contamination of the contact charging member increases the resistance of the contact charging member with the result of decrease of the charging property.

It is preferable to use a magnetic brush charger as the contact charging member in the cleanerless transfer type image forming apparatus, since then the influence of the toner contamination is relatively small. When the magnetic brush charger is used as the contact charging member, the cleaner-less system with the simultaneous collection of the untransferred toner, is as follows for example.

Most of the untransferred toner remaining in the image bearing member after the transfer process, is charged to the opposite polarity which is opposite from the normal (regular) charging polarity of the toner due to the separation discharge or the like. Generally, the charged potential is lower than the voltage applied to the contact charging member, the toner is temporarily collected by the magnetic brush portion of the magnetic brush charger (contact charging member) from the image bearing member before it reaches the developing means by the surface movement of the image bearing member.

The untransferred toner collected by the magnetic brush portion of the magnetic brush charger is recharged to the normal charge polarity by the triboelectric charge with the magnetic particle constituting the magnetic brush portion, and is ejected to the image bearing member because of the potential difference. The ejected toner returns to the developing station, and is collected to the developing means by the fog removing potential difference during the development.

However, when the image formation Is repeated in such a contact charging type image forming apparatus using the cleaner-less system, a positive ghost image occurred which is a light image of previous image pattern, because of insufficient collection of the residual toner by the developing means.

The positive ghost image occurs by the event that image bearing member portion under the residual toner is not charged when the portion passes through the contact charging member position, and therefore, the potential difference (Vback) for the collection of the residual is not provided for the image bearing member portion. This is remarkable when the contact charging member is contaminated.

In order to charge the image bearing member portion under the residual toner, it is effective to remove the toner from the image bearing member surface during the charging, and to do this, it is desirable to superimpose an alternating voltage to the voltage to be applied to the contact charging member during the charging.

By the application of the alternating voltage, the charging property is improved, and in addition, Coulomb force is applied to the toner in the direction of removing the toner from the image bearing member surface, and therefore, the advantage is large in the cleaner-less system.

On the other hand, the untransferred toner collected temporarily to the contact charging member from the image bearing member surface is ejected to the image bearing member as described hereinbefore. However, if the ejection is not sufficient, and the toner amount ejected to the image bearing member from the contact charging member is small as compared with the collected toner amount from the image bearing member surface to the contact charging member (imbalance), the toner having a relatively high electric resistance remains in the contact charging member, thus integrating the toner contamination of the contact charging member (increase of the mixture ratio of the toner relative to the contact charging member), with the result that resistance of the entirety or a part of the contact charging member increases, and therefore, the image bearing member is not charged to the desired potential, or the charging non-uniformity occurs (image defect).

As regards the ejection of the toner from the contact charging member to the image bearing member, the superimposed alternating voltage relative to the applied voltage to the contact charging member during the charging tends to slightly lower the toner discharge power.

This is because the superimposing of the alternating voltage to the voltage to be applied to the contact charging member enhances the charging property to such an extension that DC component of the applied voltage and the charged potential are substantially equal to each other, so that amount of ejection of the toner from the contact charging member to the image bearing member decreases, in other words, the imbalance occurs between the collected toner amount to the contact charging member and the toner amount ejected to the image bearing member from the contact charging member, with the result of increased mixture ratio of the toner in the contact charging member.

SUMMARY OF THE INVENTION

Accordingly, it is a principal object of the present invention to provide an image forming apparatus wherein the charging property is improved by application of an oscillating voltage to a charging member.

It is another object of the present invention to provide an image forming apparatus wherein ghost image is prevented by application of an oscillating voltage to a charging member.

It is a further object of the present invention to provide an image forming apparatus wherein toner is efficiently moved from a charging member to an image bearing member even when an oscillating voltage is applied to a charging member.

It is a further object of the present invention to provide an image forming apparatus wherein a charging member is prevented from being contaminated with toner beyond a tolerable level.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
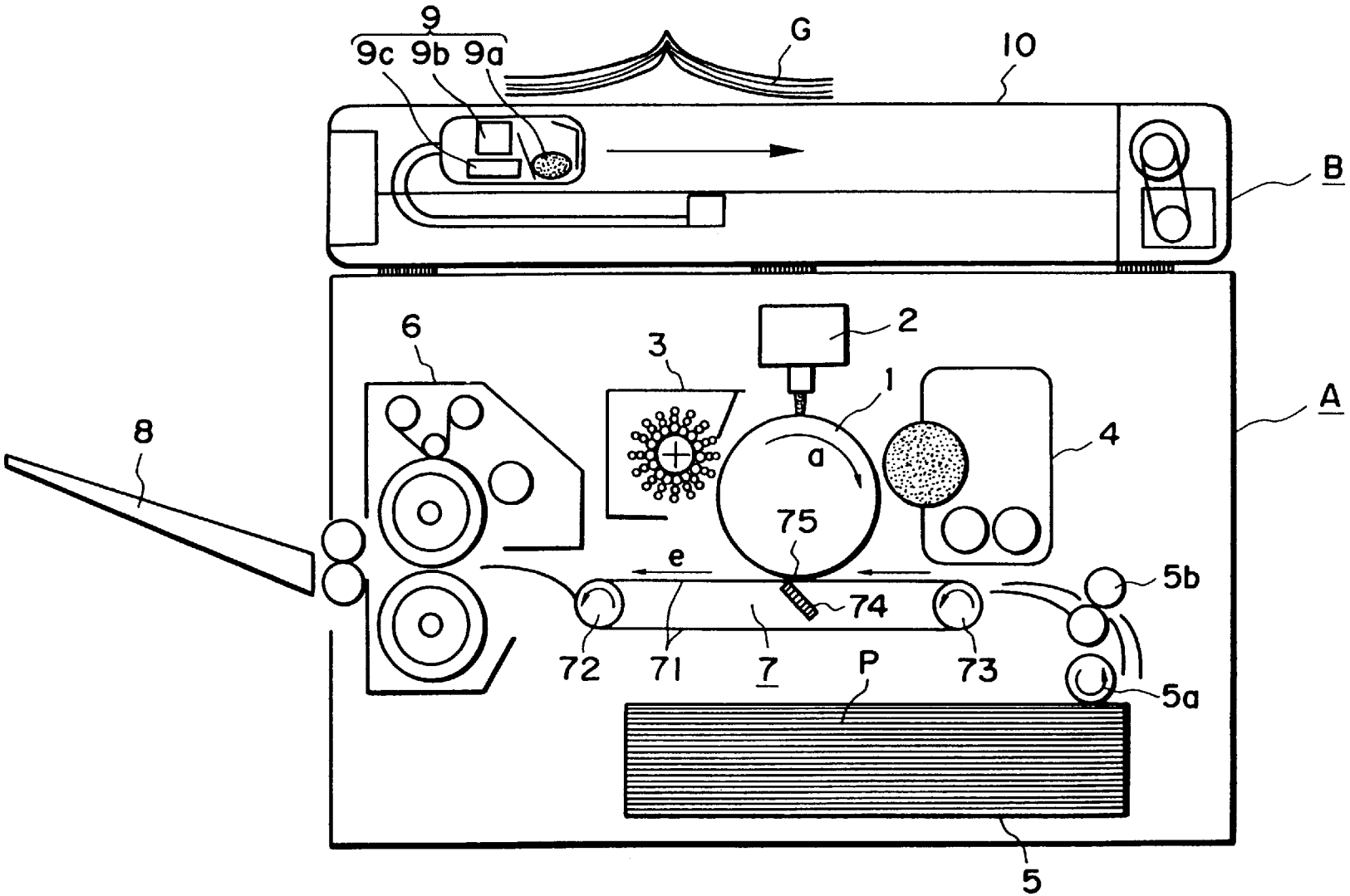
FIG. 1 is a schematic view of an image forming apparatus according to Embodiment 1.

FIG. 1 is a schematic illustration of an example of an image forming apparatus according to an embodiment of the present invention.

The image forming-apparatus of the embodiment is a digital printer using a transfer type electrophotographic process, a magnetic brush charger (contact charging type), a reverse development type and a cleaner-less system.

In FIG. 1, designated by A is a main assembly of a printer, B is an image reader (image reading apparatus) carried thereon.

(1) image reader B

In the image reader B, designated by 10 is a fixed original carriage (transparent plate of glass or the like), and on the original carriage 10, an original carriage 10 is placed faced down, and an unshown original cover is placed thereon.

Designated by 9 is a lamp 9*a* for original projection, and is in the form of an image reading unit comprising a short focus lens array 9*b* and a CCD sensor 9*c* and the like. When a copy start signal is produced, the unit 9 is moved along a lower surface of the original carriage from the home position at the left-hand side to the right-hand side below the original carriage 10, and when it reaches to the predetermined end of the forward movement, it is returned to the home position.

During the forward movement driving stroke of the unit 9, the bottom image surface of the original G placed on the original carriage 10 is illuminated and scanned from the left-hand side to the right-hand side by a lamp 9*a* of the unit 9 for original projection, and the light reflected by the surface of the original is imaged on the CCD sensor 9*c* by the short focus lens array 9*b*.

The CCD sensor 9*c* comprises a light receiving portion, a transfer portion and an output portion. A light signal is converted to a charge signal by the light receiving CCD portion, and the charge signal is transferred to an output portion in synchronization with clock pulses by a transfer portion. In the output portion, the charge signal is converted to a voltage signal, which is then amplified with impedance reduction treatment, and the resultant signal is outputted. The analog signal provided in this manner, is subjected to a known image processing, so that digital signal is produced and is fed to the printer A.

Namely, the image reader B carries out photoelectric reading of the image information of the original G and conversion thereof to a time series electrical digital pixel signal (image signal).

(2) main assembly A of the printer a) Designated by 1 is a rotatable drum type electrophotographic photosensitive member as an image bearing member (member to be charged). The photosensitive drum 1 is rotated in the clockwise direction a indicated by an arrow at a predetermined peripheral speed (process speed) about a center supporting shaft.

The photosensitive drum 1 of this embodiment is an organic photosensitive member having a diameter of 30 mm and having an injection charging property and negative charging property, and is rotated at a peripheral speed of 100 mm/sec. The layer structure of the photosensitive drum 1 will be described in detail hereinafter (3).

b) the outer surface of the photosensitive drum 1 is electrically charged (primary charging) to 650V by a magnetic brush charger 3 as a contact charging member (contact-type charging means) during the rotation thereof. The magnetic brush charger 3 will be described in detail in (4).

c) the uniformly charged surface of the rotatable photosensitive drum 1 is exposed to emitted scanning exposure which is rendered on and off in accordance with image signal (time-series type digital electric signal of image corresponding to the image information) fed to the main assembly A of the printer from the image reader B, through LED exposure means 2, so that electrostatic latent image is sequentially formed on the surface of the photosensitive drum 1, corresponding to the image information of the original G read by the image reader B. More particularly, the potential of the exposure portion lowers ((light portion potential) so that contrast is provided between the non-exposed portion potential ((dark portion potential) and the exposure portion, and an electrostatic latent image corresponding to the exposure pattern is formed.

The formed electrostatic latent image on the surface of the rotatable photosensitive drum 1 is developed sequentially into a toner image by the developing device 4. In this embodiment, a reverse development system is used. The developing device 4 of this example is a contact-type developing device using a so-called two component developer containing toner particles and carrier particles. The structure of the developing device 4 will be described in detail hereinafter which will be described hereinafter (5).

e) on the other hand, a transfer material P as a recording material stacked in a sheet feeding cassette 5 is picked up by a sheet feeding roller 5*a* one by one, and is fed to a transfer portion 75 formed as a contact nip between the photosensitive drum 1 and the transferring device 7, at a predetermined control timing by registration rollers 5*b*. The toner image is electrostatically transferred onto the surface of the transfer material P from the surface of the photosensitive drum 1.

In this example, the transferring device 7 is in the form of a belt transferring device. The transferring device 6 will be described in detail hereinafter (6).

f) the transfer material P now having the transferred toner image at the transfer portion 75, is sequentially separated from the surface of the photosensitive drum 1, and is fed to a fixing device 6 where the toner image is heat fixed thereon, and then is discharged onto the sheet discharge tray 8 as a copy or print.

g) the main assembly A of the printer is not provided with a cleaning device (cleaner) exclusively for removing the residual toner from the surface of the rotatable photosensitive drum 1 after the toner image transfer, and the developing device 4 has a function of collection or removing the residual toner from the surface of the photosensitive drum 1, namely, the developing device 4 functions also as a cleaning means (cleaner-less system). This will be described in detail hereinafter (7).

(3) a photosensitive drum

The photosensitive drum 1 as the image bearing member may be a normal organic photosensitive member or the like. Desirably, however, the organic photosensitive member is provided with a surface layer having a resistivity of $10^9$–$10^{14}$ Ωcm, or a surface layer of amorphous silicon (amorphous silicon photosensitive member), since then the injection charging can be used, the ozone production can be prevented, and the electric energy consumption can be reduced. The charging property may also be improved.

Figure 3:
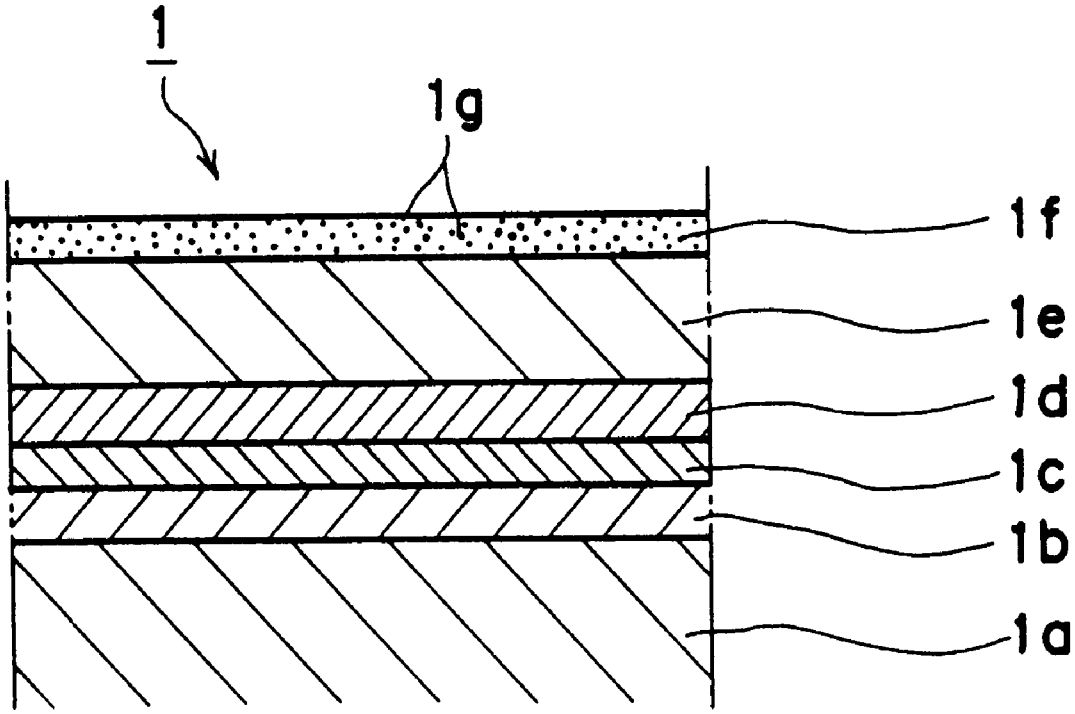
FIG. 3 is a schematic view of a layer structure of a photosensitive drum.

The photosensitive drum 1 in this example is an injection-chargeable organic photosensitive member of a negative-charging property, and as shown in FIG. 3, it comprises a drum base member (aluminum base) 1*a* of aluminum having a diameter of 30 mm, and it has first–fifth layers 1*b*–1*f* in this order from the base side.

First layer 1*b:* this is a primer layer effective to uniform the drawbacks of the drum base member 1*a* and is an electroconductive layer having a thickness of 20 μm.

Second layer 1*c:* this is a positive-charge injection preventing layer for preventing cancellation of the negative charge given to the charging by the positive-charge injected from the drum base member 1*a,* and is an intermediate resistance layer having a thickness of 1 μm and having a resistance adjusted to approx. $1\times10^6$ Ωcm by AMILAN (tradename of polyamide resin material, available from Toray Kabushiki Kaisha, Japan) resin material and methoxymethyl nylon.

Third layer 1*d:* this is a charge generating layer comprising a resin material and disazo pigment and having a thickness of approx. 0.3 μm, and generates positive and negative charge when it is exposed to light.

Fourth layer 1*e*: this is a charge transfer layer composed of P-type semiconductor created by dispersing hydrazone in polycarbonate resin. Therefore, the negative charge on the photosensitive member surface cannot move through this layer, and only the positive charge generated in the charge generating layer can be transferred onto the photosensitive member surface.

Fifth layer 1*f:* this is a charge injection layer and is a coating layer of an insulative resin material binder in which electroconductive fine particles and $SnO_2$ ultra-fine particles 1*g* are dispersed. More particularly, it comprises insulative resin material and 70% by weight, on the basis of the resin material, of $SnO_2$ particles having a particle size of 0.03 μm which are doped with light transmissive electroconductive filler of antimony to reduce the resistance (electroconductive). Such coating liquid is applied into a thickness of approx. 3 μm through a proper coating method such as a dip coating method, a spray coating method, a roller coating method and a beam coating method.

(4) magnetic brush charger 3

The magnetic brush charger 3 as the contact charging member is a rotatable sleeve type in this embodiment.

Figure 2:
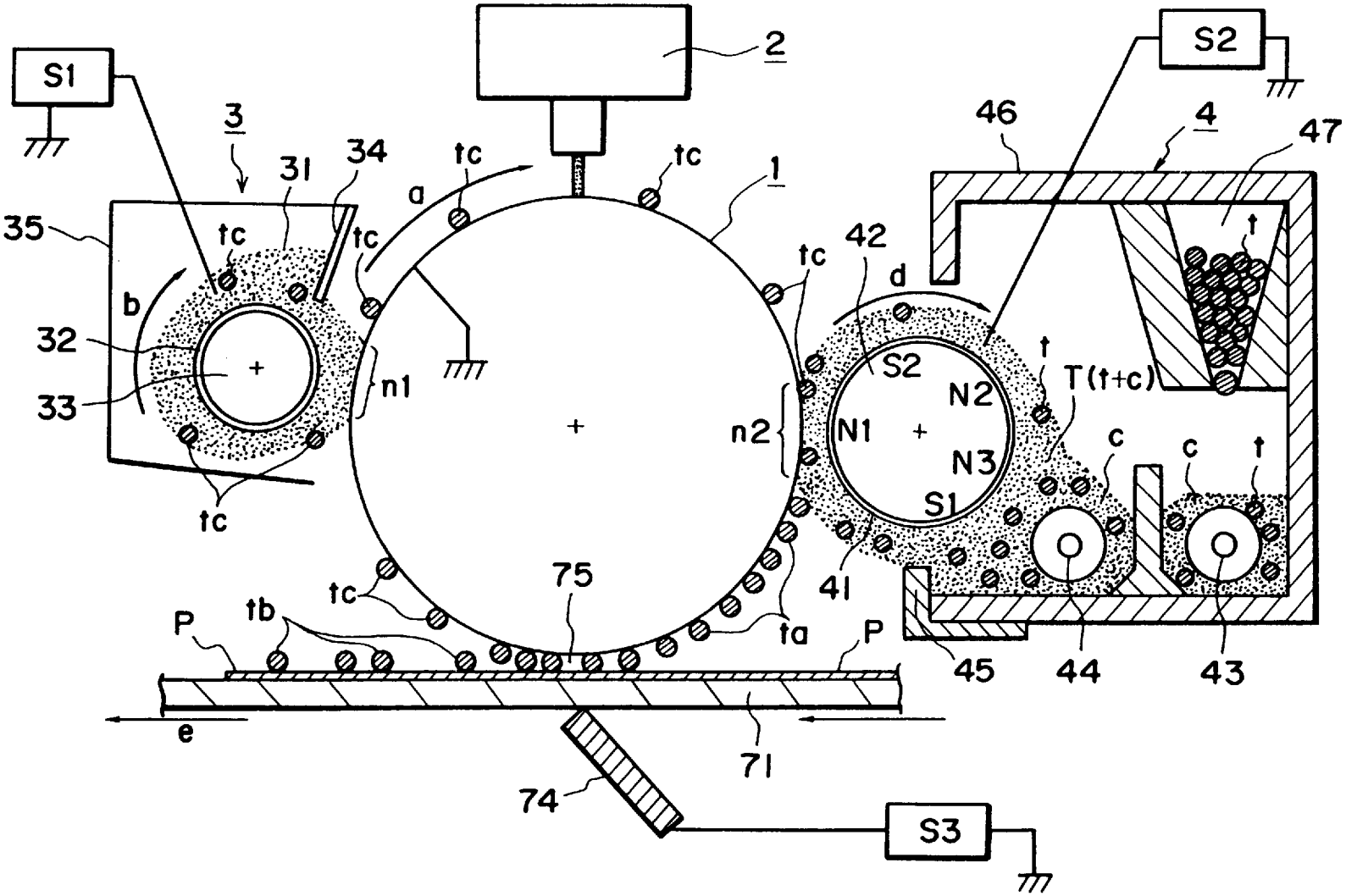
FIG. 2 is an enlarged view of a major part thereof.

As shown in FIG. 2, the magnetic brush charger 3 comprises a magnet roller 33, a non-magnetic sleeve 32 of aluminum or the like having an outer diameter of 16 mm, which sleeve is fitted rotatably around the magnet roller 33 coaxially therewith, and a magnetic brush portion 31 of magnetic particles (magnetic carrier) deposited and retained in the form of a brush on the outer surface of the sleeve by the magnetic force of the inner magnet roller 33, and is extended in a direction of a generating line of the photosensitive drum 1.

The magnet roller 33 is fixed on a housing 35, and the non-magnetic sleeve 32 is rotated at a predetermined peripheral speed in a clockwise direction b indicated by the arrow by an unshown driving system. The layer thickness of the magnetic brush portion 31 of the magnetic particle is regulated by a regulating blade 34.

The charging magnetic particles used in this embodiment each comprise ferrite particles having a surface which has a resistance adjusted by oxide and deoxidization process, and 1.0% by weight of coating material thereon which has a resistance adjusted by carbon black dispersed silicon resin material.

The core of the magnetic particle has an average particle size of 10–100 μm, a saturation magnetization of 20–250 emu/cm$^3$, and a resistance of $10^2$–$10^{10}$ Ωcm. In view of a drawback such as a pin hole of the photosensitive drum 1, the volume resistivity is preferably not less than $10^6$ Ωcm. In order to improve the charging property, the resistance is preferably as small as possible, and it is preferably not more than $10^9$ Ωcm from the standpoint of uniform charging.

Figure 4:
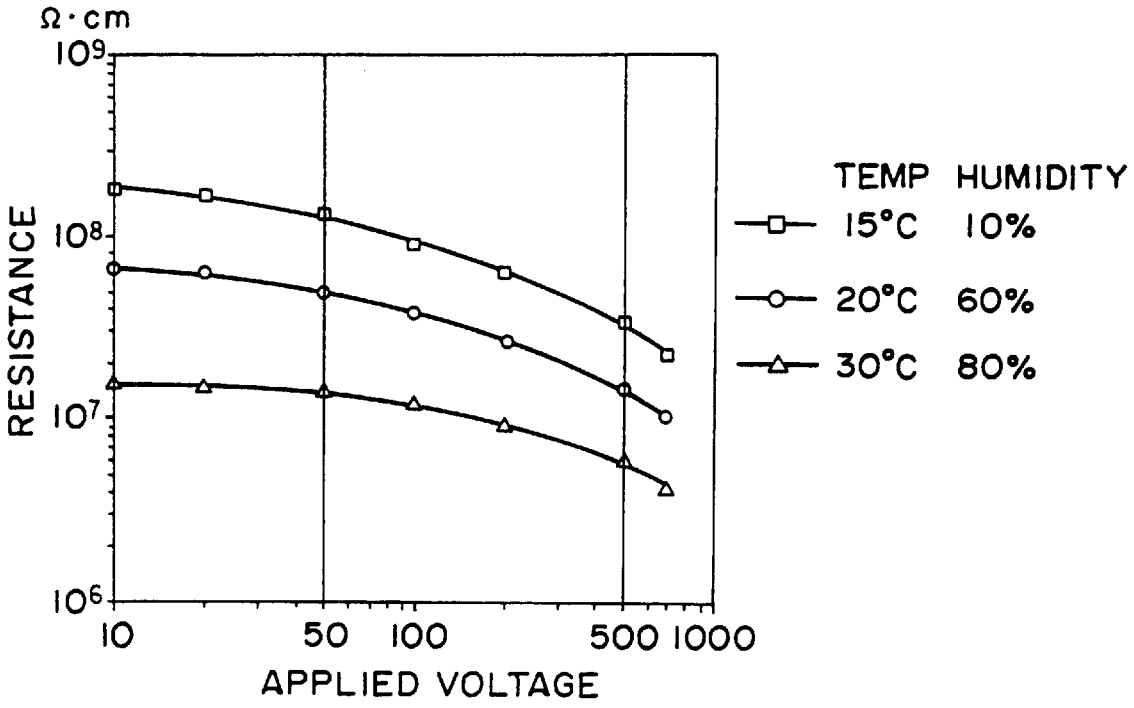
FIG. 4 is show an applied voltage to charging magnetic particles vs. resistance thereof.

The magnetic particles used in this embodiment have an average particle size of 25 μm, a saturation magnetization of 200 emu/cm$^3$, and exhibits a resistance value property shown in FIG. 4 relative to the applied voltage.

The resistance value property of the magnetic particle of FIG. 4 is determined by a cell method, wherein 2 g of the magnetic particles are placed in a metal cell having a bottom surface area of 228 $mm^2$, and is loaded with 6.6 $Kg/cm^2$. A voltage is applied thereto, and the current is measured.

The magnetic brush portion 31 of the magnetic brush charger 3 is contacted to the surface of the photosensitive drum 1 with a predetermined contact width. The contact portion n1 is the charging portion. In this example, the charging portion n1 has a width of approx. 6 mm.

The non-magnetic sleeve 32 is rotated at a predetermined peripheral speed in the clockwise direction b indicated by the arrow through an unshown driving system, namely, a counter-direction relative to the rotational direction of the photosensitive drum 1 in the charging portion n1 where the magnetic brush portion 31 is contacted to the photosensitive drum 1. In this example, the non-magnetic sleeve 32 is rotated at 150 mm/sec while the photosensitive drum 1 is rotated at a peripheral speed of 100 mm/sec.

With the rotation of the non-magnetic sleeve 32, the magnetic brush portion 31 holder by magnetic confinement on the outer surface of the non-magnetic sleeve 32 is rotated in the same direction as the non-magnetic sleeve 32 with the rotation of the non-magnetic sleeve 32, and the layer thickness thereof is regulated by a blade 34, and it rubs the surface of the photosensitive drum 1 in the charging portion n1.

The non-magnetic sleeve 32 is supplied with a predetermined charged potential from a charging voltage application source S1, and the charge is given to the photosensitive drum 1 from the charging magnetic particle constituting the magnetic brush portion 31 to charge it to the potential close to the charged potential.

Figure 6A:
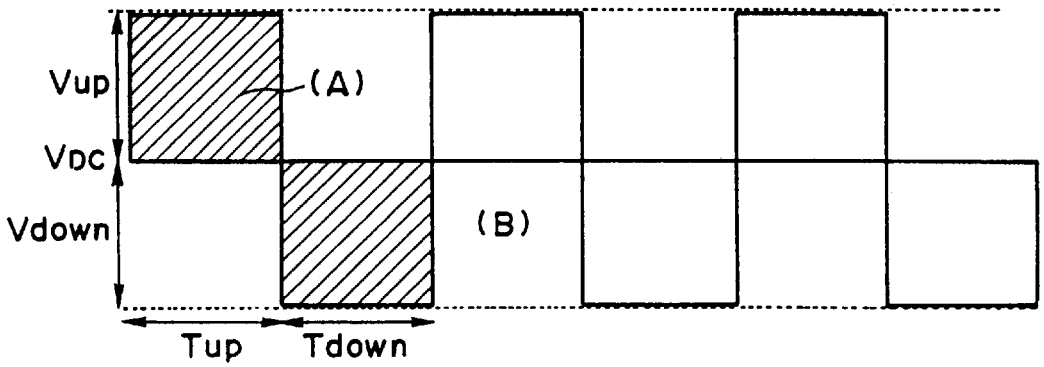
FIG. 6 is a schematic view of a waveform of an alternating voltage used in an embodiment.
Figure 6B:
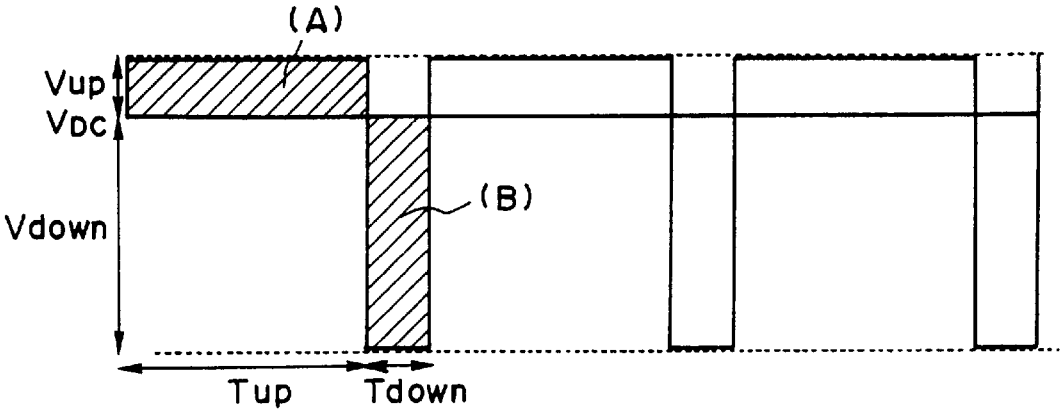
Figure 6C:
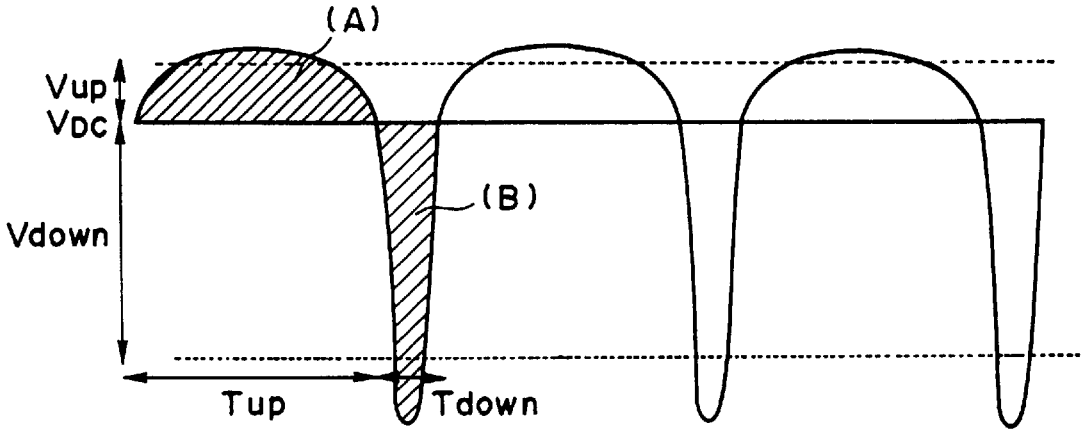

As for the charging conditions in this embodiment, the non-magnetic sleeve 32 of the magnetic brush charger 3 is supplied with an oscillating voltage comprising a DC voltage component of −650V and an alternating voltage of the waveform as shown in FIG. 6, (*b*).

The alternating voltage shown in (b) of FIG. 6 has a frequency of Vf=4000 HZ, an amplitude of Vpp=1000 V ($V_{up}+V_{down}$), wherein $V_{up}$=200V, $V_{down}$=800V, $T_{up}$=0.8 and $T_{down}$=0.2, so that following is satisfied.

$$V_{up}<V_{down}\ (T_{up}>T_{down}) \quad \text{a.}$$

$$V_{up}\times T_{up}=V_{down}\times T_{down} \quad \text{b.}$$

$V_{DC}$ in (b) of FIG. 6 indicates a value of the DC voltage, $V_{DC}$ is an average voltage, in one period, of the oscillating voltage in the form of a DC voltage biased with the alternating voltage. Therefore, the area of (A) is equal to the area of (B). $T_{up}$ is a ratio of the time of the charging polarity side beyond the average voltage relative to the one period of the oscillating voltage, and $T_{down}$ is the ratio of the time of the opposite polarity side relative thereto. $V_{up}$ is an average of a potential difference between the voltage in the charging polarity side beyond the average voltage and the average voltage in one period, and in the case of a rectangular wave shown in FIG. 6, (*b*), it is a potential difference between the maximum voltage of the oscillating voltage and the average voltage in one period. $V_{down}$ is an average of potential differences between the voltages at the opposite polarity side beyond the average voltage in one period and an average voltage in one period, and in a rectangular wave as shown in FIG. 6, (*b*), it is equal to the potential difference between the minimum voltage of the oscillating voltage and the average voltage in one period. A sum of $V_{up}$ and $V_{down}$ is a peak-to-peak voltage of the oscillating voltage.

The oscillating voltage as shown in FIG. 6, (*b*) may be produced through any method, for example, it may be produced using only by a DC voltage source, or may be produced using only by a rectangular wave AC voltage source.

Figure 5:
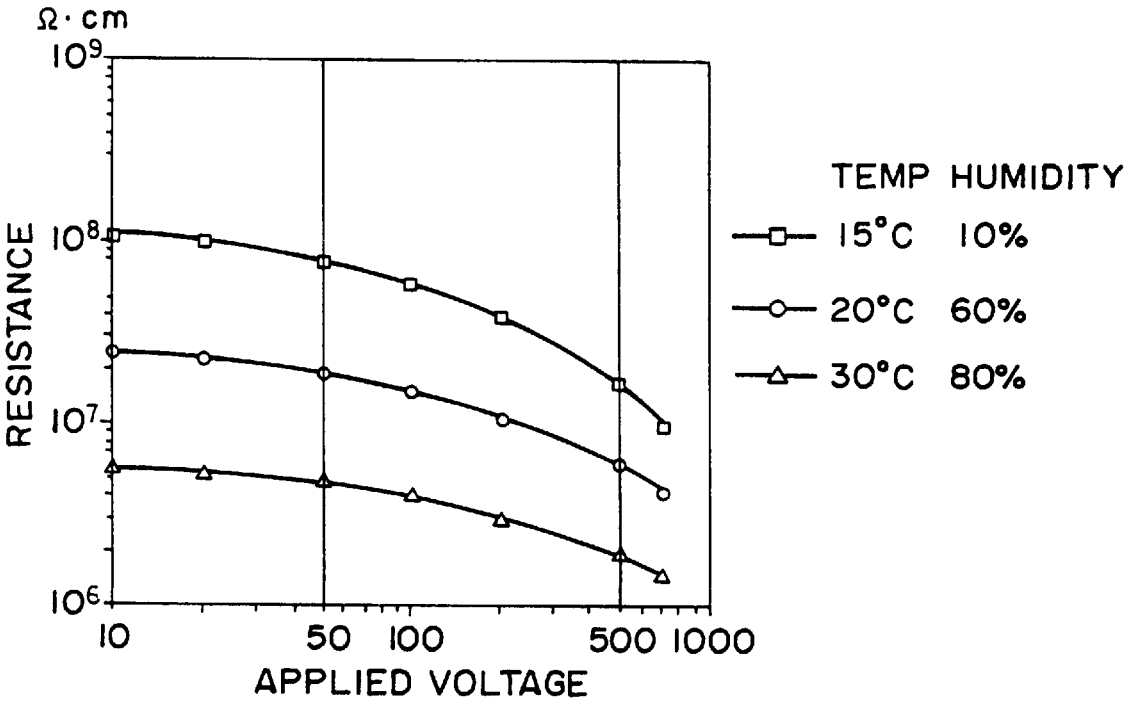
FIG. 5 shows an applied voltage to charging magnetic particle vs. resistance value property.

FIG. 5 shows a resistance value property relative to an applied voltage to the charging magnetic particle in the magnetic brush portion 31 of the magnetic brush charger 3, which property is determined through a relation among the applied voltage, the current and the contact nip, when a magnetic brush charger 3 is contacted to an aluminum drum as a substitute for the photosensitive drum 1, and the voltage is applied (measurement through the magnetic brush method). The resistance value property of the charging magnetic particle determined through the magnetic brush method and the resistance value property of the charging magnetic particle determined through the cell method (FIG. 4), are not equal, but it is common that resistance is lower if the applied voltage is higher.

The tendency applies to most of the intermediate resistance magnetic particles. For example, it is assumed that resistance value is R50 when 50V is applied, and the resistance value an is R500 when 500V is applied.

According to FIG. 4 (cell method), under 20° C., 60%;

$$R50=6.5\times10^7\ \Omega cm>R500=1.2\times10^7\ \Omega cm$$

According to FIG. 5 (measurement through the magnetic brush method), it is under 20° C., 60%;

$$R50=2.6\times10^7\ \Omega cm>R500=4.0\times10^6\ \Omega cm$$

Thus, the resistance is smaller in the case of 500V application.

(5) developing device 4

Generally, the developing methods for the electrostatic latent image is classified into the following 4 groups:

a. Non-magnetic toner is applied on a sleeve using a blade or the like, and magnetic toner is applied on a sleeve using magnetic force, and the toner is carried to the developing zone where the toner is faced to the photosensitive drum without contact thereto ((one component non-contact development).

b. The toner applied in the same manner is contacted to the photosensitive drum ((one component contact development).

c. The developer is a mixture of toner particles and magnetic carrier particles, and is carried by magnetic force to a developing zone where it is contacted to the photosensitive drum (two component contact development).

d. Such a two component developer is not contacted to the photosensitive member (two component non-contact development).

From the standpoint of image quality improvement and highly stable, the two component contact developing method (C) is widely used.

The developing device 4 in this example is a two component contact developing device (two-component magnetic brush type development apparatus). In FIG. 2, designated by 41 is a developing sleeve rotated in the clockwise direction d indicated by the arrow, 42 is a magnet roller stationarily provided in the developing sleeve 41, 43, 44 are developer stirring screws, 45 is a regulating blade for forming a thin layer of the developer T on the surface of the developing sleeve 41, 46 is a developing container, and 47 is a toner hopper for replenishing the developer.

The developing sleeve 41 is disposed such that closest gap relative to the photosensitive drum 1 is approx. 500 μm at least during the development operation, and the thin layer of the developer T formed on the surface of the developing sleeve 41 is contacted to the photosensitive drum 1 during the development operation. Designated by n2 is a developer contact region (developing zone) for the photosensitive drum 1.

The two component developer T used in this example is a mixture of toner particles t and developing magnetic carrier c, and the toner particle t is a negative charged toner particle having an average particle size of 6 μm, externally added with 1.5% by weight of titanium oxide particles having an average particle size of 20 nm, and the magnetic carrier c has a saturation magnetization of 205 emu/$cm^3$ and an average particle size of 35 μm. The developer T is a mixture of such toner t and developing magnetic carrier C at a weight ratio 8:92.

In FIG. 2, the toner t is exaggerated for better illustration relative to the charging magnetic particles constituting the magnetic brush portion 31 of the magnetic brush charger 3 or relative to the developing magnetic carrier c. For the same reason, the dimensional ratio among the various members are not correct.

The triboelectric charge amount of the toner t in the developer T was approx. $-25\times10^{-3}$ c/kg.

Figure 7:
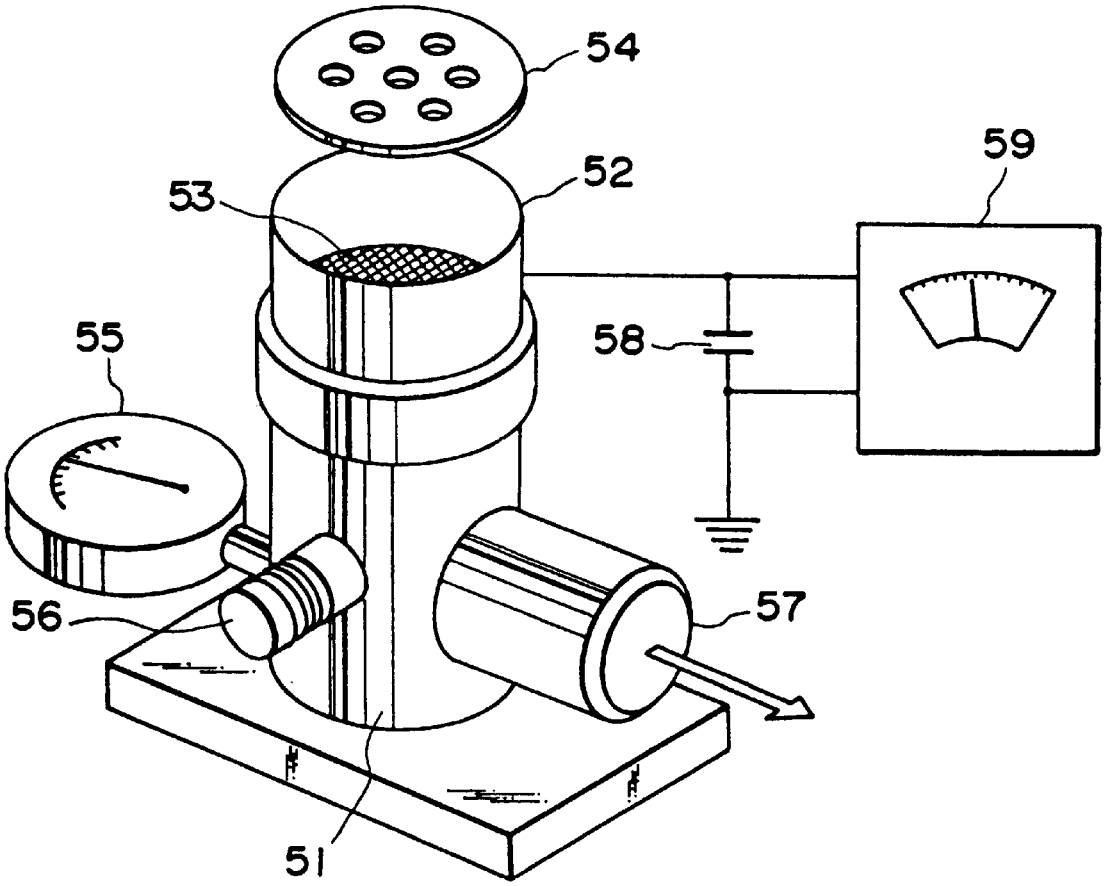
FIG. 7 is an illustration of measuring manner of charge amount of the charge amount.

Referring to FIG. 7, the measuring method and the measuring device for the triboelectric charge amount (triboelectric charge amount of electric charge) of the toner will be described in detail. A two component developer to be measured which is a mixture of toner particles t and the magnetic carrier c particles (weight ratio is 5:95), is placed in a polyethylene bin having a capacity of 50–100 ml; then, the bin is shaken for approx. 10–40 sec; approx. 0.5–1.5 g of the developer is then taken out and is placed in a measurement container 52 of metal having a screen 53 of 800 mesh; the measurement container 52 is capped with a metal cap 54.

The weight of the entirety of the measurement container 52 is W1(kg).

Then, by a suction means 51 wherein at least a portion thereof contacted to the measurement container 52 is of insulation member), the air is sucked out through a suction opening 57 to 250 mmAq of the inner pressure measured by a vacuum meter 55, by controlling a flow control valve 56.

The resin materials are sucked out by sufficient suction for 2 min. Preferably. The potential indicated by the electrometer 59 is V (volt). Here, designated by 58 is a capacitor having a capacity of C(F). The weight of the entirety of the measurement container 52 after the suction is W2(kg).

The triboelectric charge amount of the toner is calculated as follows:

Triboelectric charge amount of the resin material (c/kg)= $C\times V\times10^{-3}/(W1-W2)$ The description will be made as to electrostatic latent image developing process and the circulation system of the developer in the developing device 4 of this embodiment.

The developing sleeve 41 is rotated in such a direction (clockwise direction d) that surface thereof moves counter-directionally relative to the surface movement of the photosensitive drum 1 in the developing zone n2. With this rotation, the developer T in the developing container 46 is taken up onto the surface of the developing sleeve 41 by the N3 pole of the magnet roller 42. Designated by S1 is a feeding pole.

When the developer formed into a thin layer reaches the developing pole N1 corresponding to the developing zone n2, it is formed into erected chains by the magnetic force thereof. The electrostatic latent image on the surface of the rotatable photosensitive drum 1 is developed into a toner image in the developing zone n2 with the toner t in the developer which is in the form of chains. In this example, the electrostatic latent image is subjected to a reverse development. Designated by ta is a toner image.

The thin developer layer on the developing sleeve 41 having passed through the developing zone n2 enters the developing container 46 with the continuing rotation of the developing sleeve 41, and is separated from the developing sleeve 41 by the repelling magnetic field provided by N2 pole and N3 pole, and returns into the developer in the developing container 46. Designated by S2 is a feeding pole.

The developing sleeve 41 is applied with a DC voltage and an AC voltage from the voltage source S2. In this example, the developing bias voltage is as follows:

DC voltage: −480V

AC voltage; Vpp=1500V, and Vf=3000 HZ

Generally, in the two-component developer type developing method, when the AC voltage is applied, the development efficiency increases, and the image quality is improved, but fog tends to occur correspondingly. Therefore, ordinarily, a potential difference is provided between the DC voltage applied to the developing device 4 and the surface potential (dark portion potential) of the photosensitive drum 1 to prevent the fog. More particularly, the potential which is between the potential of the exposure portion of the photosensitive drum 1 and the potential of the non-exposed portion is applied as the developing voltage.

The potential difference is called a fog preventing potential (Vback), and is effective to prevent deposition of the toner onto the non-image region (non-exposed portion) of the surface of the photosensitive drum 1 during the development operation, and in an apparatus of the cleaner-less system type, the residual toner is collected from the surface of the photosensitive drum 1 ((simultaneous development and cleaning). More particularly, the electric field for depositing the toner to the light portion of the drum from the developing sleeve, and the electric field for moving the toner to the developing Sleeve from the dark portion of the drum, are simultaneously formed.

The toner content is monitored by an unshown sensor for detecting the toner content of the developer T in the developing container 46, and when the toner content becomes lower than a predetermined content as a result of the consumption of the toner t for the development of the latent image in the developer T, the toner supplementing is carried out from the toner hopper 47 into the developing container 46. By this, the toner content in the developer T is maintained constant (6) transferring device 7

The transferring device 7 of this embodiment is a belt transferring device, wherein an endless transfer belt 71 is stretched around a driving roller 72 and a follower roller 73, and is rotated at the peripheral speed which is substantially the same as the peripheral speed of the photosensitive drum 1 in the counterclockwise direction indicated by an arrow e. Inside the endless transfer belt 71, there is provided a transfer charging blade 74, and the blade 74 urges a middle portion of the upper portion of the transfer belt 71 to contact it to the surface of the photosensitive drum 1 to form a transfer portion (transfer nip) 75.

A transfer material P is carried on the upper part of the transfer belt 71, and is fed to the transfer portion 71. When the leading edge of the fed transfer material P enters the transfer portion 75, the transfer charging blade 74 is supplied with a predetermined transfer bias from a transfer voltage application voltage source S3, so that charge of the opposite polarity from the toner is applied to the back side of the transfer material P to transfer the toner image ta from the photosensitive drum 1 onto the transfer material P (tb) sequentially.

In this example, the belt 71 is of polyimide resin material and has a film thickness of 75 μm. The material of the belt 71 is not limited to polyimide resin material, but may be of polycarbonate resin material, polyethylene terephthalate resin material, polyvinylidene fluoride resin material, polyethylenenaphthalate resin material, polyetheretherketone resin material, polyether sulfone resin material, polyurethane resin material or another plastic resin material, or a fluorine or silicon rubber. As regards the thickness, it is not limited to 75 μm, but may range approx. 25–200 μm, preferably 50–150 μm.

The transfer charging blade 74 has a resistance of $1\times10^5$–$1\times10^7\Omega$, a thickness of 2 mm, and a length of 306 mm. The transfer charging blade 74 is supplied with a bias of +15 μA under a constant-current-control to effect the image transfer.

The toner image ta formed on the photosensitive drum 1 in this manner is electrostatically transferred onto the transfer material P by the transfer charging blade 74.

The transfer belt 71 functions also as a feeding means for feeding the transfer material P to the fixing device 6 from the transfer portion 75, and the transfer material P passed through the transfer portion 75 is separated from the surface of the rotatable photosensitive drum 1, and is fed to and introduced to the fixing device 6 by the transfer belt 71.

(7) cleaner-less system and alternating voltage

The printer A of this example is not provided with a cleaning device exclusively for removing the residual toner tc remaining on the surface of the rotatable photosensitive drum 1 after toner image transfer onto the transfer material P, but the developing device 4 functions as cleaning means for collecting the residual toner tc remaining on the surface of the photosensitive drum 1 (cleaner-less system).

The present invention accomplishes the decrease of the mixing ratio of the toner into the contact charging member 3 by promoting the ejection of the toner to the image bearing member 1 from the contact charging member 3 by increasing the potential difference between the DC component of the charging bias and the charged potential of the image bearing member which difference determines the toner ejection property to the image hearing member 1 from the contact charging member 3 and the collection of the toner to the contact charging member 3 from the image bearing member 1, while maintaining the improved effect of the charging property by the superimposing of the alternating voltage to the voltage supplied to the contact charging member 3 and the production preventing effect of the positive ghost image. In other words, the toner contamination of the contact charging member 3 beyond a tolerable range is realized, and output of the satisfactory images without the image defect can be maintained for a term.

(1) in the transfer portion 75, the untransferred toner tc remains on the surface of the photosensitive drum 1 after toner image transfer onto the transfer material P.

Some of the untransferred toner tc is charged to a polarity opposite from the regular polarity (negative in this example) due to the separation discharge in the transfer action, and the other has the regular polarity (positive).

The untransferred toner tc having different polarities on the photosensitive drum 1 is carried to the charging portion n1 which is a contact portion between the magnetic brush portion 31 of the magnetic brush charger 3 (contact charging member) and the photosensitive drum 1 by the rotation of the continuing photosensitive drum 1.

(2) in the charging portion n1, the charging step for the photosensitive drum surface is carried out while removing the residual toner from the surface of the photosensitive drum 1, (1) by the rubbing of the surface of the photosensitive drum 1 with the magnetic brush portion 31 of the magnetic brush charger 3 to break the untransferred toner pattern, (2) by removing the residual toner tc from the surface of the photosensitive drum 1 by the alternating voltage applied to the magnetic brush charger 3, (3) by temporarily collecting the residual toner tc having the opposite polarity by the magnetic brush portion 31 from the surface of the photosensitive drum 1 by electric attraction force due to the charged potential applied to the magnetic brush charger 3 in the charging portion n1. Therefore, the portion of the photosensitive member under the untransferred toner is sufficient, by which the positive ghost image is prevented from occurring.

The inclusion of the alternating voltage in the charging bias for the magnetic brush charger 3 is effective to significantly improve the charging power &LD&V (the difference between the potential provided by one turn and the saturated potential) and to improve the removal of the residual toner from the photosensitive drum 1 to the magnetic brush charger 3 in the charging portion n1 during the charging operation.

The regular polarity toner among the residual toner, the potential is generally lower than the applied charging potential to the magnetic brush charger 3, and therefore, is not collected by the magnetic brush portion 31, and is stirred and passed through the charging portion n1 on the surface of the photosensitive drum 1.

(3) the residual toner having the opposite charge polarity and having collected temporarily by the magnetic brush portion 31 of the magnetic brush charger 3, is recharged to the regular charging polarity (negative) by the triboelectric charge with the charging magnetic particle constituting the magnetic brush portion 31, and is uniformly ejected to the photosensitive drum 1 by the electrical repelling force due to the charged potential applied to the magnetic brush charger 3.

The toner ejected to the surface of the photosensitive drum 1 from the magnetic brush charger 3 is very uniformly distributed, and the amount thereof is very small, so that it does not have substantial adverse influence to the next image exposure process. Therefore, the drum surface charged by the magnetic brush charger 3, is subjected to an image exposure while carrying such toner, and the electrostatic latent image is formed.

(4) the residual toner having the regular polarity (negative) having passed through the charging portion n1 without being collected by the magnetic brush portion 31 in the charging portion n1, and the residual toner ejected onto the photosensitive drum 1 recharged to the regular charging polarity after temporary collection to the magnetic brush portion 31 in the charging portion n1 because of its polarity, are both carried by the rotation of the photosensitive drum 1 to the developing zone n2 where the developing sleeve 41 of the developing device 4 is opposed to the photosensitive drum 1, and the toner deposited on the white background portion is collected into the developing device 4 by the tog removing potential Vback (simultaneous development and cleaning) and is reused, and a part of the toner deposited on the image portion is used for the development.

(5) if the toner is not sufficiently ejected to the photosensitive drum 1 from the magnetic brush charger 3, and the imbalance results between the collected toner amount to the magnetic brush charger 3 from the surface of the photosensitive drum 1 and the toner amount ejected to the photosensitive drum 1 from the magnetic brush charger 3, the toner having a relatively high electric resistance is accumulated in the magnetic brush portion 31 of the magnetic brush charger 3 with the result that toner contamination of the magnetic brush charger 3 expands (increase of the mixing ratio of the toner), and the resistance of the entirety or a part of the magnetic brush charger increases. If this occurs, the photosensitive drum 1 is not charged to the desired potential, or the charging non-uniformity and therefore image defect results.

The toner ejection to the photosensitive drum 1 from the magnetic brush charger 3 is stronger if the charged potential is lower as compared with the DC component of the applied voltage to the magnetic brush charger 3.

However, if the charged potential is simply lower than the applied voltage, the charging property is low, and for example, the charging power may be different between the portion exposed to light in the previous rotation and the portion not exposed to the light in the previous rotation, with the result of surface potential difference therebetween, and therefore, the occurrence of the positive ghost image due to the charging.

Therefore, what is done in this example is not (a) lowering the potential provided by the charging device after the one turn, but is (b) lowering the saturated potential of the photosensitive member than the applied voltage, by which the difference between the saturated potential and the charged potential after the one turn is reduced, so that both of the discharge property of the introduced toner in the magnetic brush charger 3 and the chargeable are realized, thus preventing the positive ghost image.

This will be described in more detail as to how to reduce the difference between the charged potential after one turn and the saturated potential by the saturated potential lower than the applied voltage, as in FIG. 8 (*b*).

The electric resistance of the charging magnetic particles used in this embodiment is dependent on the applied voltage, such that resistance is lower when a high voltage is applied than when a low voltage is applied. The measurements of the electric resistance value of the charging magnetic particle with the applied voltage changed under 3 conditions through the two different measuring methods (cell method and magnetic brush method), as shown in FIG. 4 and FIG. 5, as described above, both show that resistance is lower when the applied voltage is higher. For example, R50>R500, where R50 is a resistance when 50V is applied, and R500 is a resistance when 500V is applied.

Using the property, the voltage applied to the non-magnetic sleeve 32 of the magnetic brush charger 3 is a DC voltage component of −650V biased with an alternating voltage component having the waveform as shown in Figure (b) of FIG. 6 in this embodiment.

The alternating voltage shown in (b) of FIG. 6 has a frequency of Vf=4000 HZ, an amplitude of Vpp=1000V ($V_{up}+V_{down}$), wherein $V_{up}$=200V, $V_{down}$=800V, $T_{up}$=0.8 and $T_{down}$=0.2, so that following is satisfied.

$$V_{up}<V_{down}\ (T_{up}>T_{down}) \quad \text{a.}$$

$$V_{up}\times T_{up}=V_{down}\times T_{down} \quad \text{b.}$$

When a normal rectangular pulse bias as shown in Figure (a) of FIG. 6 is used (frequency Vf=4000 HZ, amplitude Vpp=1000V ($V_{up}+V_{down}$), $V_{up}$=−500V, $V_{down}$=500V, $T_{up}$=0.5, $T_{down}$=0.5), the following happens. In a latter part of the (a) charging step in the charging nip, the photosensitive drum is charged close to −650V which is the applied bias, and therefore, because of the potential difference, when the charging operation shown in (A) and (B) of FIG. 6 is carried out, the resistance of the charging magnetic particle is the one when 500V is applied, that is, resistance R500, and therefore, the amount of electric charge injected during the charging is equivalent to the ones in (A) and (B), so that converged charged potential is close to −650V which is a bias value of the application DC component.

When the alternating voltage as shown in Figure (b) of FIG. 6 as in this embodiment, the following happens. In the latter part of the charging step in the charging portion (charging nip) n1, the photosensitive drum 1 is charged to −650V which is the applied voltage, and therefore, because of the potential difference, in the (A) portion of the alternating voltage, the resistance of the charging magnetic particles is the one when 200V is applied, that is, resistance R200, and in the (B) portion of the charging, the resistance of the magnetic particles is the one when 800V is applied, that is, resistance R800.

Accordingly, even though the integrated value of the waveform of the alternating voltage is the same in (A) and (B), the resistance is different (R200>R800), so that infection currents are difference, and the potential becomes lower, and the converged potential is lower than −650V.

Figure 8A:
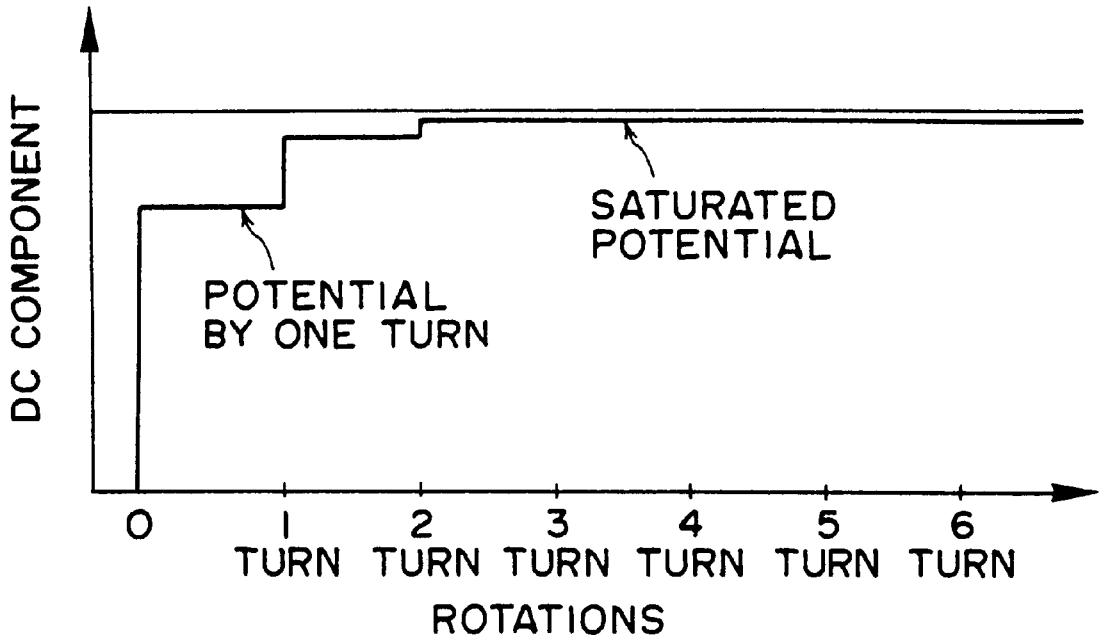
FIG. 8 is a schematic view of a surface potential relative to number of rotations of a photosensitive drum.
Figure 8B:
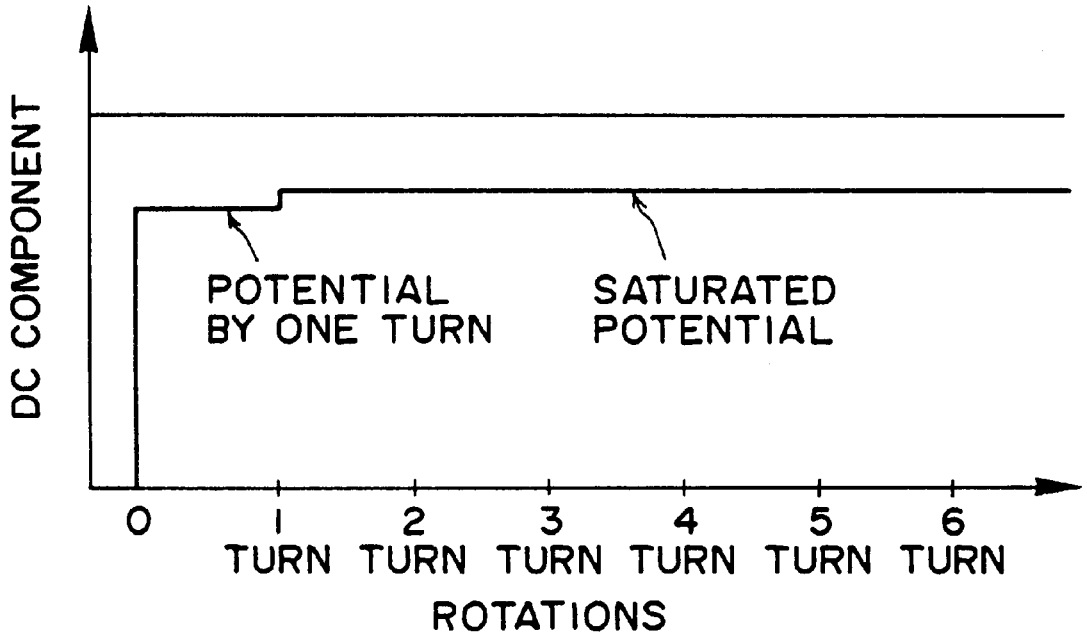

This occurs not by reducing the charging property, but by reducing the saturated charged potential by the difference of the injection current, and therefore, the charged potential can be lowered while maintaining a small difference between the saturated charged potential and the potential after one turn, as shown in Figure (b) of FIG. 8. Thus, the discharging power of the introduced toner and the high chargeable are both accomplished, so that positive ghost image can be prevented.

Figure 9:
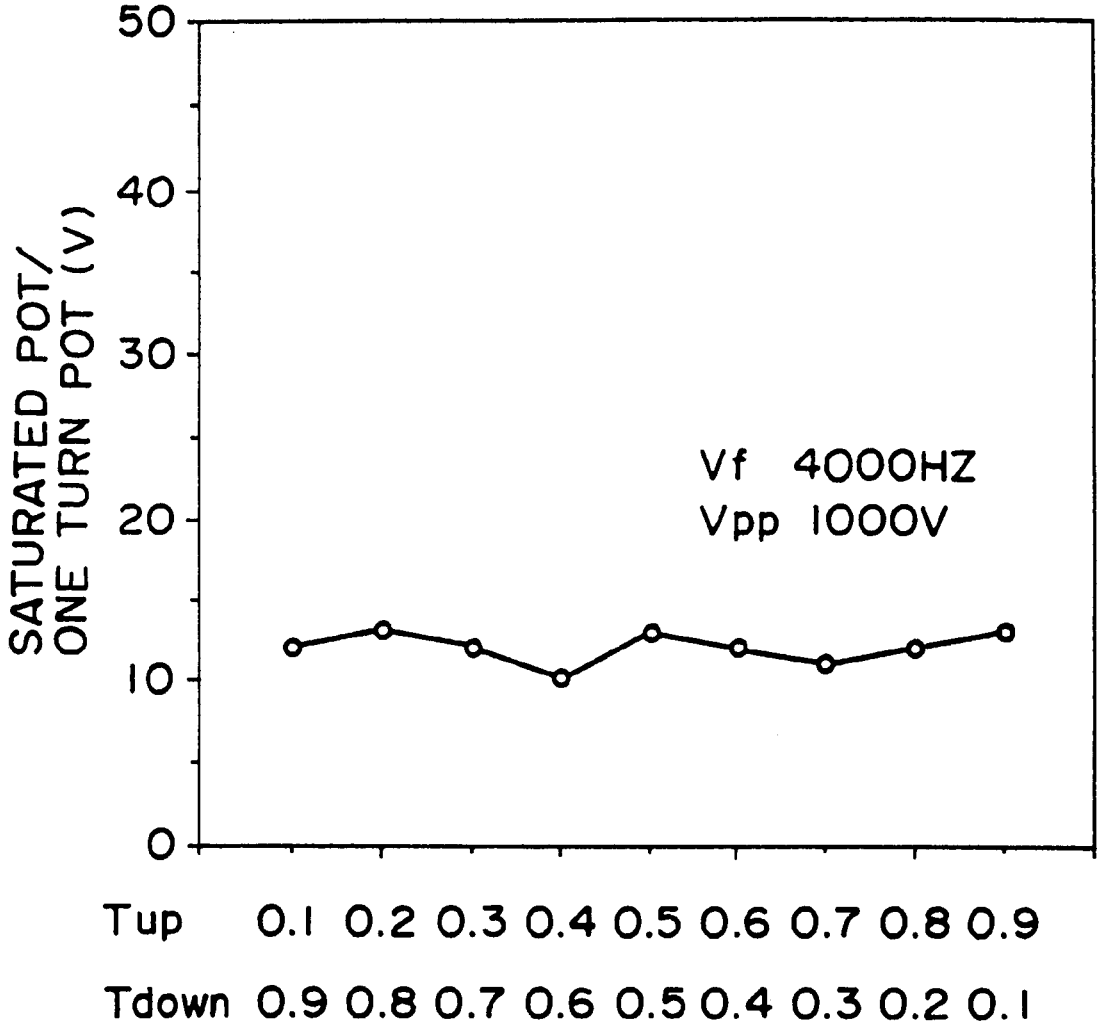
FIG. 9 is a graph showing a difference between a potential after one full rotation and a saturated charged potential when a waveform of an alternating voltage is changed.

FIG. 9 shows a result of investigation of the difference between the saturated charged potential and the potential after one turn when the $T_{up}$ and $T_{down}$ are changed under the condition of the frequency Vf=4000 Hz, amplitude Vpp=1000V. It is understood that difference between the saturated charged potential and the potential after one full turn, which is indicative of the charging power hardly changes even if the saturated charged potential changes.

This is accomplished if the condition that $V_{up}$ in (A) portion is smaller than $V_{down}$ in (B) portion, and $T_{up}$ of (A) portion is longer than $T_{down}$ of (B) portion, in (b) of FIG. 6, is satisfied.

Figure 10:
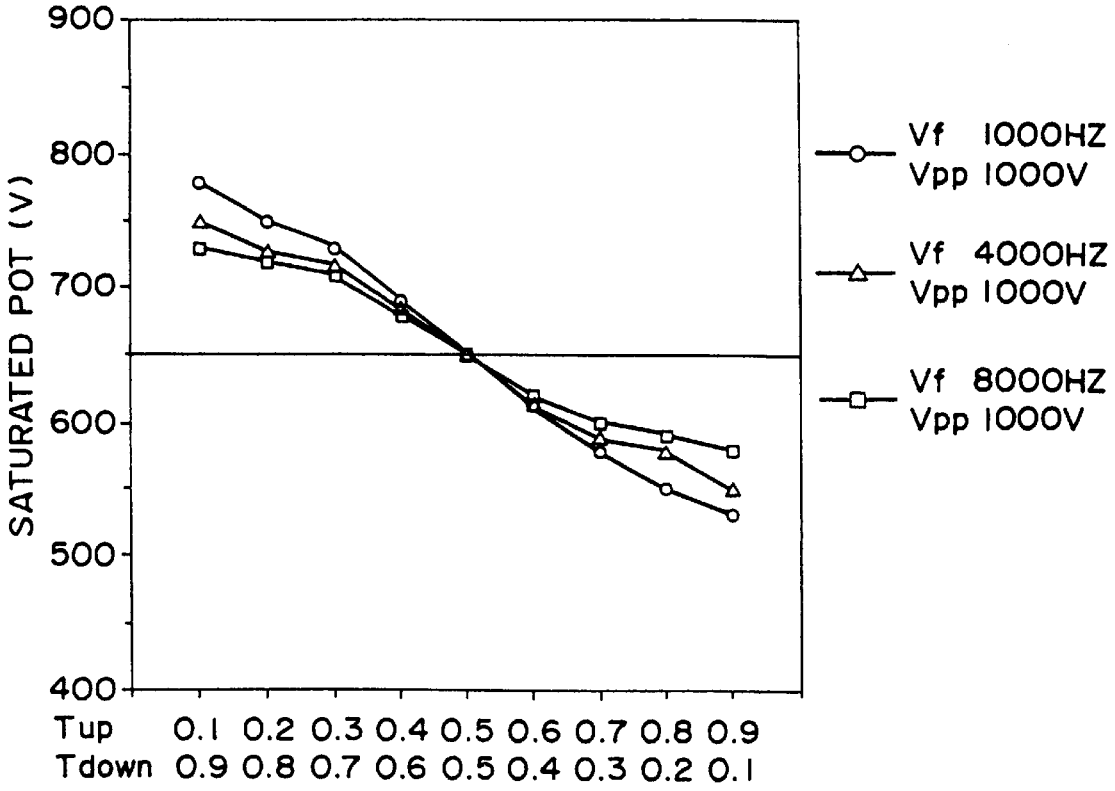
FIG. 10 is a saturated charged potential graph (frequency dependence) when a waveform of an alternating voltage is changed.

FIG. 10 shows a change of the saturated charged potential when the frequency Vf is 1000 HZ, 4000 HZ or 8000 HZ, and the amplitude Vpp is fixed at 1000 V, whereas $T_{up}$ and $T_{down}$ are changed.

Figure 11:
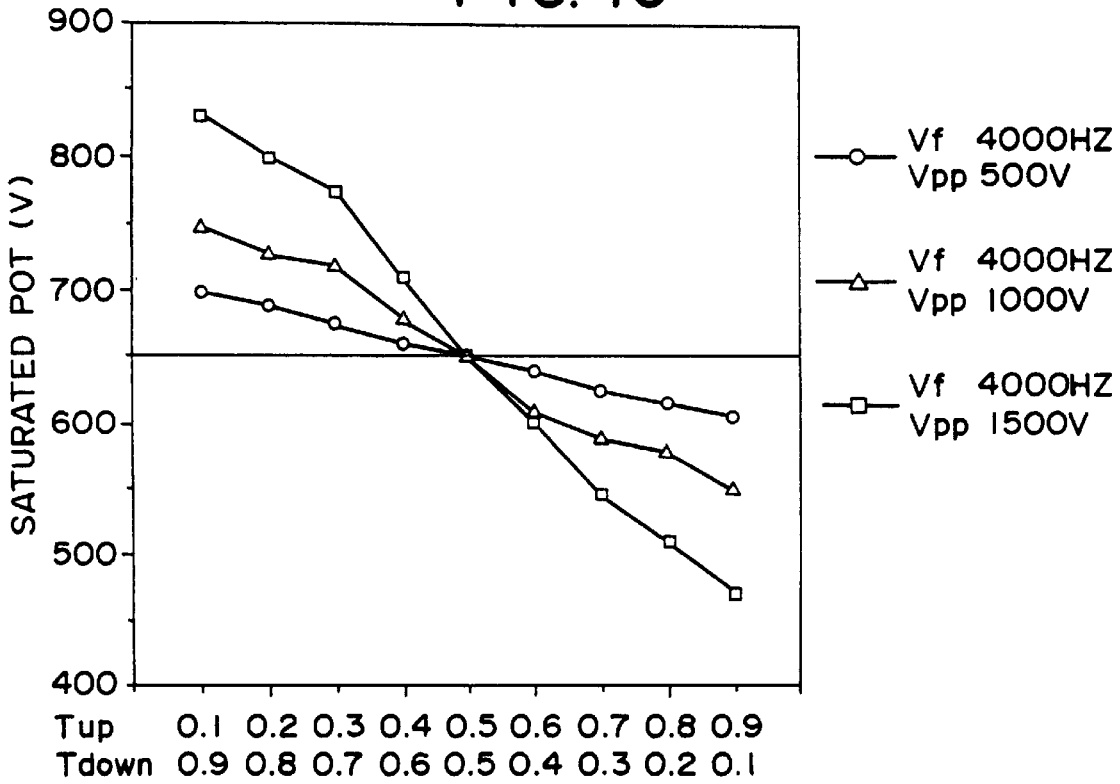
FIG. 11 is a saturated charged potential graph (amplitude dependence) when a waveform of an alternating voltage is changed.

FIG. 11 shows a change of the saturated charged potential when the frequency Vf is fixed at 4000 HZ, and the amplitude Vpp is 500V, 1000 V or 1500V, whereas $T_{up}$ and $T_{down}$ are changed.

From FIGS. 10 and 11, the saturated charged potential lowers when the $T_{up}$ in the (A) portion of the alternating voltage is longer than $T_{down}$ of (B) portion, and the saturated charged potential rises when (A) portion of the alternating voltage is shorter than $T_{down}$ of (B) portion.

For each case of $T_{up}$:$T_{down}$ of 0.2:0.8, 0.5:0.5 and 0.8:0.2, image forming operations were carried out for 1000 sheets, and thereafter, the charging magnetic particles were removed using surfactant to measure the amount of the mixture of the toner. The amount of introduced toner when the ratio was 0.2:0.8>that when the ration was 0.5:0.5>that when the ration was 0.8:0.2, so that it was confirmed that amount of introduced toner could be decreased when the saturated charged potential was low.

As described in the foregoing, in an image forming apparatus wherein the developing device 3 functions also as means for collecting the untransferred toner, the magnetic brush charger 3 is applied with an oscillating voltage in the form of a DC voltage superimposed with an alternating voltage, and the following is satisfied:

$$T_{up}>T_{down}$$

By doing so, the saturated potential is lowered by the difference of the injection current without deteriorating the charging property, and therefore, the charged Potential can be lowered while maintaining small difference between the saturated potential and the potential after one full turn, as shown in FIG. 8, (*b*). Thus, the discharging power of the introduced toner and the high chargeable are both accomplished, so that positive ghost image can be prevented.

Embodiment 2

In Embodiment 1, the use is made with an alternating voltage of rectangular wave shown in (b) of FIG. 6, and $T_{up}$, $T_{down}$ and $V_{up}$, $V_{down}$ are changed, but the alternating voltage is not limited to the rectangular wave shown in (b) of FIG. 6.

In this embodiment, the use is made with a waveform shown in (c) of FIG. 6, and $T_{up}$, $T_{down}$ and $V_{up}$, $V_{down}$ are changed. The change of the saturated charged potential, the comparison of the amount of introduced toner into the magnetic brush charger, and the difference between the saturated charged potential and the potential after one turn, are evaluated.

It is confirmed with the waveform of the alternating voltage shown in (C) of FIG. 6 that when $V_{up}$ of (A) portion of the alternating voltage is smaller than $V_{down}$ of (B) portion, and $T_{up}$ of (A) portion is longer than $T_{down}$ of (B) portion, the saturated charged potential is lower than the applied DC voltage, so that amount of introduced toner is lowered, and the difference between the saturated charged potential and the potential after one turn is maintained small.

In FIG. 6, (*c*), $V_{DC}$ is an average voltage of the oscillating voltage in one period, and an area of (A) is equal to an area of (B).

$T_{up}$ is a ratio of the time length when the voltage is at the charging polarity side beyond the average voltage in one period to the time length of one period of the oscillating voltage, and $T_{down}$ is a ratio of the time length when the voltage is at the opposite side beyond the average voltage. $V_{up}$ is an average of the potential difference between the voltage at the charging polarity side beyond the average voltage in one period and the average voltage in one period, and $V_{down}$ is an average of a potential difference between the voltage at the opposite side beyond the average voltage and the average voltage.

Therefore, in an image forming apparatus wherein the developing device 3 functions also as means for collecting the untransferred toner, the voltage applied to the magnetic brush charger 3 is an oscillating voltage in the form of a DC voltage biased with an alternating voltage, and the following is satisfied;

$$T_{up}>T_{down}$$

By doing so, the saturated potential is lowered by the difference of the injection current without deteriorating the charging property, and therefore, the charged potential can be lowered while maintaining the small difference between the saturated charged potential and the potential after one turn without the waveform of the alternating voltage. Thus, the discharging power of the introduced toner and the high chargeable are both accomplished, so that positive ghost image can be prevented.

Embodiment 3

In Embodiments 1, 2, the oscillating voltage applied to the magnetic brush charger 3 which is a contact charging member satisfies:

$$T_{up}>T_{down}$$

It is constant irrespective of image formation period or non-image-formation period, but in a simple image forming apparatus not provided with potential measuring means, it is effective that $V_{up}=V_{down}$ ($T_{up}=T_{down}$) is satisfied during the image formation to make the charged potential substantially equal to the charging DC bias, and in a predetermined period during the non-image formation, $V_{up}<V_{down}$ and ($T_{up}>T_{down}$) is satisfied, because the charged potential slightly changes depending on the resistance of the magnetic particle. More particularly, for the area on the photosensitive member which is going to be an image region, $T_{up}=T_{down}$ is satisfied, and for at least a part of the area which is going to be the non-image region, $T_{up}>T_{down}$ is satisfied.

In such a case, the toner ejection power during the image formation is relatively low, but the ejection power is high during the sheet interval period or pre-rotation process (non-image formation period), so that toner mixing ratio of the magnetic brush charger 3 can be suppressed.

Figure 12:
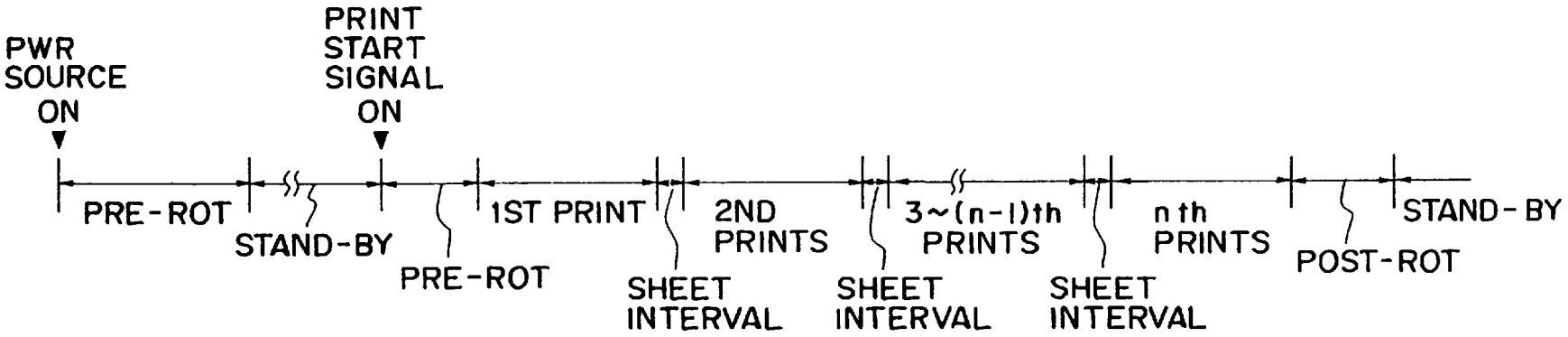
FIG. 12 shows an operation of the image forming apparatus.
Figure 13:
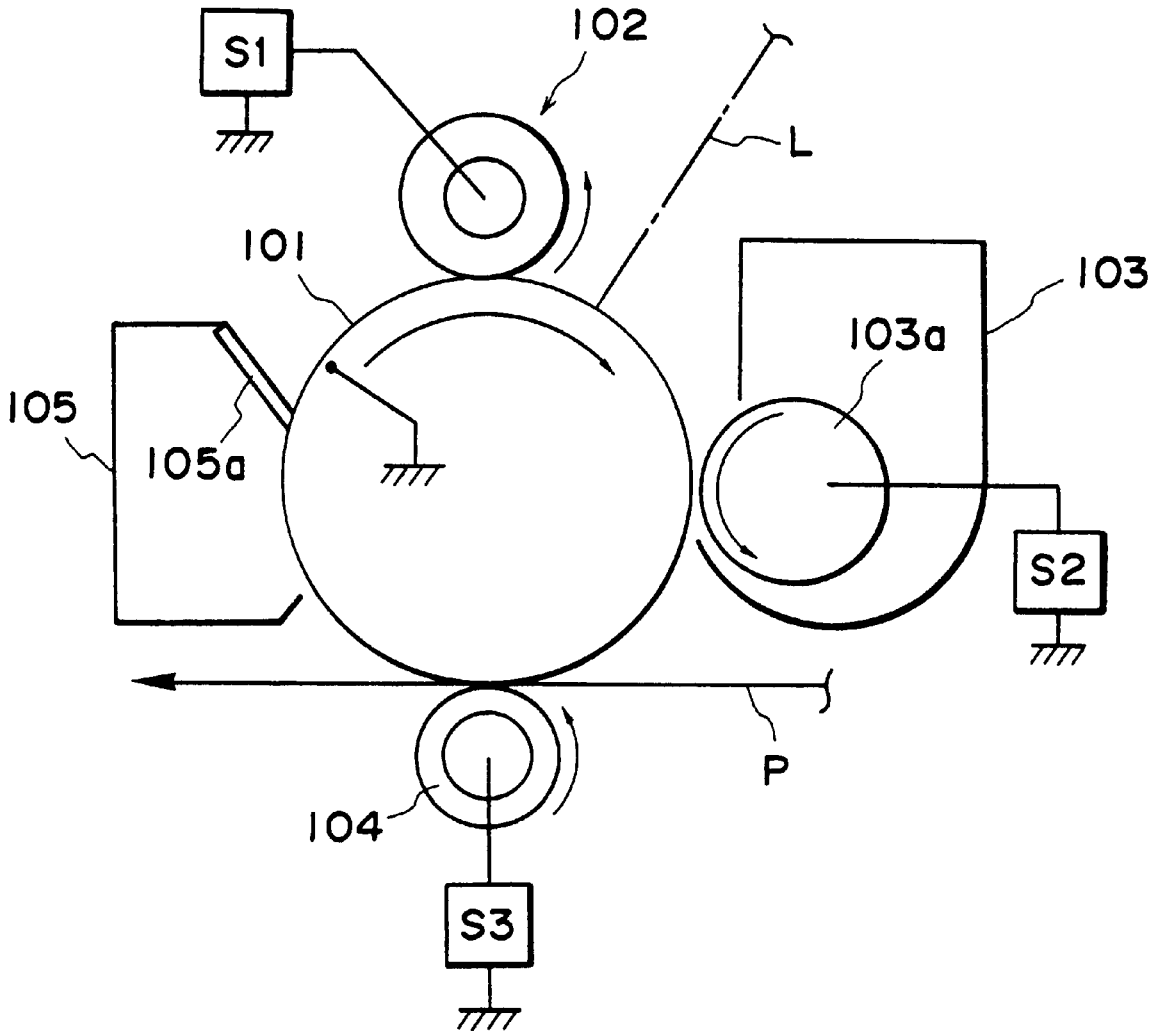
FIG. 13 is a schematic illustration of a conventional image forming apparatus.

FIG. 12 shows an example of the operation process in the image forming apparatus. The operation process is controlled by a predetermined sequence control through an unshown electrical control system.

a. Prior multi-rotation step

Start (starting) operation period (warming period) of image forming apparatus By actuation of a main voltage source switch, the main motor of the apparatus is driven to rotate the photosensitive drum 1, and preparing operations are carried out by predetermined process means.

After the completion of the predetermined apparatus starting operation period, the driving of the main motor is once stopped, and the rotation of the photosensitive drum 1 is stopped, so that apparatus is maintained in a stand-by (stand-by) state until a printing start signal is produced.

b. Pre-rotation process

This is such a period that in response to the printing start signal, the main motor is reactuated to re-rotate the photosensitive drum 1, and predetermined preparatory operations are carried out for a period.

c. Printing process (image formation process)

When the predetermined pre-rotation process is completed, the printing process (image formation process and image forming process) are carried out to the rotatable photosensitive drum 1 through predetermined sequence, and the transfer material P having received the transferred toner image is fed to the fixing device 6, and the first printing operation is carried out.

In the case of the continuous printing (continuous print) mode, the printing process is repeated, and the preset number of the printing operations are carried out.

d. Sheet interval period

This is a period in which after the trailing edge of the transfer material P has passed through the transfer portion 75 and before the leading edge of the next transfer material P reaches the transfer portion 75 in the continuous printing mode, that is, the period in which the transfer material P is not present in the transfer portion 75.

e. Post-rotation process

This is a period after the completion of the printing process for n-th sheet (final sheet), and in this period, the main motor continues rotation to rotate the photosensitive drum 1, and predetermined post-operations are carried out.

After the completion of the post-rotation process, the main motor is stopped, and the rotation of the photosensitive drum 1 stops, so that apparatus is placed in the stand-by state until the next printing start signal is produced.

When a printing start signal is produced immediately after the pre-rotation, the printing process is executed without the stand-by state. When only one print is instructed, the apparatus is placed in the stand-by state after the post-rotation process after the printing process.

The image formation period of above c is the period of the printing process of the image forming apparatus, and the periods of the pre-rotation (a), the pre-rotation (b) and the sheet interval period (d) and the post-rotation process (e) are the non-image formation periods.

In the image forming apparatus wherein the developing device 3 functions to collect the untransferred toner, the oscillating voltage applied to the magnetic brush charger 3 when such an area of the image bearing member which is going to be the non-image region is at the charging position, satisfies:

$$T_{up} > T_{down}$$

By the application of such a voltage at least for a certain duration, the saturated potential is lowered by the difference of the injection current without lowering the charging property, so that charged potential can be lowered. Thus, the discharging power of the introduced toner and the high chargeable are both accomplished, so that positive ghost image can be prevented.

Others

1) It is preferable that photosensitive member as the image bearing member has a low resistance layer having a surface resistance of $10^9$–$10^{14}$ Ωcm, since then the charge injection is effected without ozone production, but an organic photosensitive member not satisfying this is usable, and also in such a case, the durability is improved.

The charging magnetic particles used in this embodiment each comprise ferrite particles having a surface which has a resistance adjusted by oxide and deoxidization process, and 1.0% by weight of coating material thereon which has a resistance adjusted by carbon black dispersed silicon resin material, but this is not limiting, and the same advantageous effects are provided when the use is made with a magnetic particle comprising a ferrite core or comprising resin material in which the magnetic member is dispersed.

In such a case, the charging magnetic particle has a property of resistance of $10^2$–$10^{10}$ Ωcm, and the resistance is lower when the voltage is higher. Thus, the charging magnetic particles usable with the present invention may be any if the above conditions are satisfied.

3) The contact charging member is not limited to the magnetic brush charger, but may be a rotary type or non-rotary type furbrush (fiber brush) charger or a charging roller or the like.

4) The developing method in the embodiments are two-component developer type developing method, but it may be another developing method. Reverse development type and regular developing system are equally usable. The charging device charges the photosensitive member and charges the untransferred toner to the regular charge polarity, and therefore, the reverse development type is preferable since then the charge polarity of the regular-charge toner is the same as the charge polarity of the photosensitive member. Preferably, the one component contact development and the two component contact development wherein the developer is contacted to the photosensitive member, since then the collecting effect simultaneous with the development is high. The toner particle in the developer may be pulverized toner or the like, and preferably, it is polymerized toner since then the residual toner is sufficiently collected in the one component non-contact development and two component non-contact development as well as in the one component contact development and two component contact development.

5) It is effective to provide a charging means for charging the untransferred toner to the polarity opposite from the regular charging polarity between the transfer portion and the magnetic brush charger in order to enhance the collection efficiency namely the removing efficiency of the untransferred toner to the magnetic brush charger from the image bearing member surface.

6) The magnetic brush charger 3 may be a rotatable sleeve type wherein the magnet roller 33 is stationary and the non-magnetic sleeve 32 is rotated, but this is not inevitable, and the magnet roller 33 may be rotated, and the sleeve may be omitted if the surface thereof is treated for electroconductive process.

7) The waveform of the oscillating voltage may be a sunisoidal wave, rectangular wave, triangular wave or the like. The oscillating voltage may be provided by periodically actuation and deactuation of a DC voltage source (rectangular wave). Thus, the oscillating voltage is a voltage having a periodically changing voltage.

The same applies to the alternating voltage component applied to the developing device.

8) The contact charging device may be a type wherein the charging by discharge phenomenon is dominant.

9) The image bearing member may be an electrostatic recording dielectric member. In such a case, the dielectric member surface is uniformly charged (primary charging) to a predetermined polarity and potential, and then, selective discharging is effected by discharging means such as a discharging needle head, electron gun or the like to form an electrostatic latent image pattern corresponding to the intended image information.

10) The transfer method may be a roller transfer, blade transfer or corona discharge transfer method. The present invention is applicable to an image forming apparatus for forming a multi-color or full-color image in addition to a monochromatic image formation forming apparatus, using an intermediary transfer member such as a transfer drum or transfer belt.

11) A detachable process cartridge type is usable wherein the image bearing member 1, the charging means 3, the developing device 4 and/or another process means is contained in a process cartridge as a unit which is detachably mountable to a main assembly of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a charging member, contactable to said image bearing member, for being supplied with a voltage to electrically charge said image bearing member, said charging member having a resistance which is larger when it is supplied with a voltage of 50V than when it is supplied with a voltage of 500V;

developing means for developing with toner an electrostatic image formed on said image bearing member using charging operation of said charging member, said developing means being capable of removing the toner from said image bearing member;

wherein the voltage is an oscillating voltage, and a ratio $T_{up}$ of time period when a voltage level thereof is in a side of a charging polarity of said charging member beyond an average voltage in one period of said oscillating voltage to a length of time of one period of said oscillating voltage, and a ratio $T_{down}$ of time period when the voltage level thereof is in a side of a polarity opposite from the charge polarity beyond the average voltage to the length of time of one period of said oscillating voltage, satisfy:

$$T_{up}>T_{down}.$$

2. An apparatus according to claim 1, wherein said oscillating voltage is applied to said charging member when such an area of said image bearing member as is going to be a non-image area is at a charging position.

3. An apparatus according to claim 1 or 2, wherein said oscillating voltage is applied to said charging member when such an area of said image bearing member as is going to be an image region is at a charging position.

4. An apparatus according to claim 2, wherein said charging member is supplied with a second oscillating voltage when such an area of said image bearing member as is going to be an image region is at a charging position, and second oscillating voltage satisfies $$T_{up}=T_{down}.$$

5. An apparatus according to claim 1, wherein said charging member is provided with a magnetic brush of magnetic particles contactable to said image bearing member.

6. An apparatus according to claim 1, wherein said image bearing member is provided with a surface layer having a volume resistivity of $10^9$–$10^{14}$ Ωcm.

7. An apparatus according to claim 6, wherein the surface layer comprises resin material and electroconductive particles.

8. An apparatus according to claim 6, wherein said image bearing member has an electrophotographic photosensitive layer inside said surface layer.

9. An apparatus according to claim 1, wherein said developing means is capable of removing toner from said image bearing member simultaneously with developing the electrostatic image with toner.

* * * * *

UNITED STATES PATENT AND TRADEMARK OFFICE

CERTIFICATE OF CORRECTION

PATENT NO. : 5,933,681

DATED : August 3, 1999

INVENTOR(S) : Hiroyuki Suzuki

It is certified that error appears in the above-identified patent and that said Letters Patent is hereby corrected as shown below:

COLUMN 4

Line 15, "ls" should read --is--;
Line 64, "exten-" should read --extent--; and
Line 65, "sion" should be deleted.

COLUMN 5

Line 36, "is show" should read --shows--; and
Line 44, "amount of the charge amount" should read --amount--.

COLUMN 6

Line 60, "650 V" should read -- -650 V --.

COLUMN 7

Line 6, "((light" should read --(light--;
Line 8, "((dark" should read --(dark--;

UNITED STATES PATENT AND TRADEMARK OFFICE

CERTIFICATE OF CORRECTION

PATENT NO. : 5,933,681

DATED : August 3, 1999

INVENTOR(S) : Hiroyuki Suzuki

It is certified that error appears in the above-identified patent and that said Letters Patent is hereby corrected as shown below:

COLUMN 7 (Cont.)

Line 63, "effective to uniform" should read --which serves to make uniform the surface--.

COLUMN 10

Line 38, "is" should read --are--.

COLUMN 13

Line 15, "silicon" should read --silicone--.

COLUMN 16

Line 25, "infec-" should read -- injec- -- and
Line 34, "the high chargeable" should read --high chargeability--.

COLUMN 17

Line 15, "Potential" should read --potential--;
Line 19, "the high chargeable" should read --high chargeability--; and

UNITED STATES PATENT AND TRADEMARK OFFICE

CERTIFICATE OF CORRECTION

PATENT NO. : 5,933,681

DATED : August 3, 1999

INVENTOR(S) : Hiroyuki Suzuki

It is certified that error appears in the above-identified patent and that said Letters Patent is hereby corrected as shown below:

COLUMN 17

Line 60, "3" should read --4--.

COLUMN 18

Line 8, "the high" should read --high chargeability--;
Line 9, "chargeable" should be deleted; and
Line 51, "(stand-by)" should be deleted.

COLUMN 19

Line 27, "3" should read --4--;
Line 39, "the high" should read --high chargeability--; and
Line 40, "chargeable" should be deleted.

UNITED STATES PATENT AND TRADEMARK OFFICE

CERTIFICATE OF CORRECTION

PATENT NO. : 5,933,681

DATED : August 3, 1999

INVENTOR(S) : Hiroyuki Suzuki

It is certified that error appears in the above-identified patent and that said Letters Patent is hereby corrected as shown below:

COLUMN 20

Line 35, "sunisoidal" should read --sinusoidal--; and
Line 36, "periodically" should read --periodic--.

Signed and Sealed this

Fourteenth Day of March, 2000

*Attest:*

Q. TODD DICKINSON

*Attesting Officer*

*Commissioner of Patents and Trademarks*